US005826525A

United States Patent [19]

Hayakawa

[11] Patent Number: 5,826,525

[45] Date of Patent: Oct. 27, 1998

[54] SEWING MACHINE HAVING DISPLAY MEANS

[75] Inventor: Atsuya Hayakawa, Chita, Japan

[73] Assignee: Brother Kogyo Kabushiki Kaisha, Nagoya, Japan

[21] Appl. No.: 902,075

[22] Filed: Jul. 29, 1997

[30] Foreign Application Priority Data

Nov. 20, 1996 [JP] Japan ..... 8-309571

[51] Int. Cl.[6] ..... D05B 21/00; D05B 69/36; D05C 9/06

[52] U.S. Cl. ..... 112/102.5; 112/273; 112/445; 112/475.04

[58] Field of Search ..... 112/102.5, 273, 112/278, 221, 445, 475.19, 475.04, 155

[56] References Cited

U.S. PATENT DOCUMENTS 4,960,061 10/1990 Tajima et al. ..... 112/445 X
5,159,888 11/1992 Morita ..... 112/221 X
5,184,560 2/1993 Asano ..... 112/273 X
5,228,403 7/1993 Sugimoto ..... 112/273 X

*Primary Examiner*—Peter Nerbun
*Attorney, Agent, or Firm*—Oliff & Berridge, PLC

[57] ABSTRACT

A sewing machine according to the invention has a display for displaying sewing data as an image corresponding to the sewing positions on a material. A material mover is controlled to move the material relative to a head without causing a needle to vertically move, and thereby the stitch position defined by the head is moved to an arbitrary point indicated on the image on the display. As a result, the material can be moved quite quickly compared with a case where the material is moved stitch by stitch. In addition, since the position to which the stitch position is moved can be confirmed on the screen, designation of that point is performed quite easily.

20 Claims, 6 Drawing Sheets

SEWING MACHINE HAVING DISPLAY MEANS

BACKGROUND OF THE INVENTION

1. Field of the Invention

This invention relates to a sewing machine, and more particularly to a sewing machine which can move a material being sewn relative to a head without vertically moving a needle.

2. Description of Related Art

In the technical field of embroidery machines, prior art embroidery machines have a so-called stitch backward/forward function, which allows a material being sewn to move relative to a head without causing a needle to vertically move. For example, in prior art embroidery machines, a workpiece holding frame which holds a material being sewn is moved two-dimensionally under a head. In embroidery machines of this kind, sewing is performed by moving the workpiece holding frame so that a stitch position stored in the sewing data is positioned right under the head and by, subsequently, lowering the needle.

In addition, in the embroidery machines of this kind, a thread breakage is detected using, for example, a sensor, and the embroidery machines are stopped upon detection of a thread breakage. Furthermore, the embroidery machines of this kind are designed to return the workpiece holding frame position stitch by stitch by tracing back the coordinate position data. By employing this structure, the workpiece holding frame can be returned to the position where a thread breakage has occurred and sewing can be restarted from that position.

However, in this case, a problem arises in that returning the workpiece holding frame stitch by stitch reduces operability and delays operation. For example, when the workpiece holding frame moves by several stitches from where it has been at the occurrence of a thread breakage before the embroidery machine is stopped, the stitch positions must be traced back sequentially. This problem occurs even when a stitch position corresponding to the current stop position of the embroidery machine is very close to the position where the thread breakage occurred. Another problem with the prior art is that the positional relationship between the needle and the material being sewn is visually checked. Therefore, experience is required to accurately return the stitch position to the desired position.

SUMMARY OF THE INVENTION

In view of the foregoing, an object of the invention is to provide a sewing machine in which the stitch position can be moved easily and quickly to a desired position by moving a material being sewn relative to a head.

To achieve this object, a sewing machine according to the invention comprises a head which drives a needle to form a stitch on a material; a material mover which moves the material relative to the head; a sewing controller which controls the head and the material mover based on sewing data and performs sewing on the material according to the sewing data; a display unit which displays the sewing data as an image; an indicator which indicates an arbitrary point on the image displayed by the display unit; and a movement controller which relatively moves the material by controlling the material mover without causing the needle to vertically move so that a stitch position defined by the head is moved to the point indicated by the indicator.

In the sewing machine structured as described above, the display unit displays the sewing data as an image corresponding to the sewing positions on the material. When an arbitrary point is indicated by the indicator, the movement controller operates as follows. The movement controller controls the material mover to move the material relative to the head without causing the needle to vertically move so that the stitch position defined by the head is moved to the point indicated by the indicator.

Since the position to which the needle position is moved is indicated on the image and the material is moved according to that point, the material can be moved quicker than a case where the material is moved stitch by stitch. In addition, since the position to which the stitch position is moved can be confirmed on the image, designation of that position is performed quite easily. Therefore, in the sewing machine according to the invention, moving the stitch position to the desired position by moving the material relative to the head can be performed easily and quickly.

According to a preferred feature of the invention, a sewing machine may comprise a head which drives a needle to form a stitch on a material; a material mover which moves the material relative to the head; a controller which controls the head and the material mover based on coordinate position data specifying stitch positions of the needle so that sewing is performed on the material according to the coordinate position data; a display unit which displays the coordinate position data as an image; a point mover which moves a point along the stitch positions on the image displayed by the display unit; and a movement controller which relatively moves the material by controlling the material mover without causing the needle to vertically move so that a stitch position defined by the head is directly moved to the point moved by the point mover regardless of other stitch positions.

In the sewing machine structured as described above, the display unit displays the coordinate position data as an image corresponding to the stitch positions on the material. The point mover moves a point along the stitch positions on the image displayed by the display unit. Then, the movement controller controls the material mover to move the material relative to the head so that the stitch position defined by the head is moved to the point moved by the point mover. This material movement is performed directly regardless of other stitch positions.

Accordingly, in the sewing machine structured as described above, the material can be moved quicker than a case where the material is moved stitch by stitch. In addition, this material movement is quite quick because it is performed directly regardless of other stitch positions. The position to which the stitch position is moved is designated by moving a point along the stitch positions specified by the coordinate position data, and it is likely to be any one of the stitch positions specified for sewing control by the coordinate position data. Therefore, the position to which the stitch position is moved can be designated quite easily. Consequently, in the sewing machine structured as described above, moving the stitch position to the desired position by moving the material relative to the head can be performed easily and quickly.

According to another feature of the invention, the sewing machine may be arranged so that the sewing controller can execute relative feed of the material or a color change of a thread to be formed into a stitch by controlling the material mover while the needle is kept raised during sewing, and that the point mover moves the point to a stitch position where the feed or the color change is executed.

In the sewing machine structured as described above, the point mover moves the point to a stitch position where the feed or the color change is executed. The position to which the stitch position is moved is likely to be any one of the stitch positions where the feed or the color change is executed among those specified by the coordinate position data. Therefore, the position to which the stitch position is moved can be designated easily and quickly.

According to another feature of the invention, the sewing machine may further comprise a thread breakage detector which detects a breakage of a thread to be formed into a stitch and a control selector which, upon detection of a thread breakage, stops the sewing controller from controlling the head and the material mover and permits the movement controller to control the material mover while the sewing controller is stopped. Accordingly, upon the occurrence of a thread breakage, operation of the sewing machine can be stopped immediately and the stitch position defined by the head can be moved quickly to the desired position (for example, to the stitch position where the thread breakage occurred). Therefore, in the sewing machine structured as described above, sewing can be restarted quickly after a thread breakage occurs.

BRIEF DESCRIPTION OF THE DRAWINGS

A preferred embodiment of the invention will be described in detail with reference to the following figures wherein.

DETAILED DESCRIPTION OF PREFERRED EMBODIMENT

An embroidery machine according to a preferred embodiment of the invention will be described with reference to the drawings.

Figure 1:
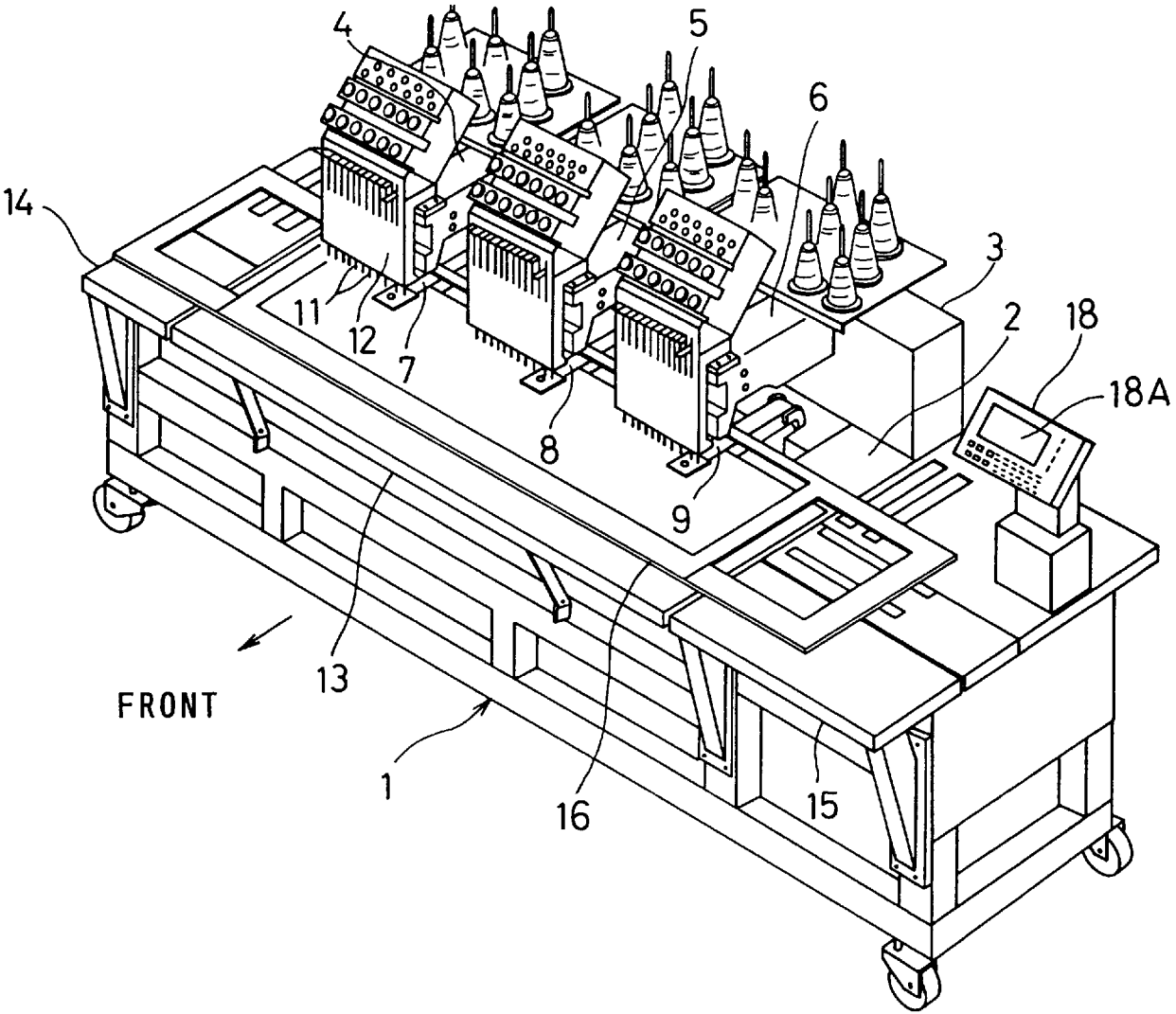
FIG. 1 is a perspective view showing a structure of an embroidery machine to which the invention is applied.

FIG. 1 is a perspective view showing the structure of an embroidery machine to which the invention is applied. The embroidery machine is a three-head embroidery machine as described below.

As shown in FIG. 1, the embroidery machine has a laterally extending base frame 1 and an embroidery machine supporting plate 2 placed at the top rear thereof. Provided vertically at the rear side of the embroidery machine supporting plate 2 is a laterally extending supporting frame 3, on which three heads 4, 5, 6 are provided at predetermined intervals. Provided on the upper surface of the base frame 1 are beds 7, 8, 9 which are opposed to the heads 4, 5, 6.

At each front end of the heads 4, 5, 6, a case 12 is laterally movably supported. Twelve needles aligned in a row are vertically movably supported in each case 12. At the front of the embroidery machine supporting plate 2, a work table 13 is placed so that the work table is as high as the upper surfaces of the beds 7, 8, 9. A rectangular workpiece holding frame 16 is provided at the top of the work table 13 and auxiliary tables 14, 15 provided on both sides thereof. The workpiece holding frame 16 is so arranged as to hold a material being sewn (not shown) and as to move in the X-axis direction (laterally) and in the Y-axis direction (forward and backward). In addition, provided at the rear of one auxiliary table 15 are a display 18*a* which displays a message about the sewing and an operation panel 18 from which various commands are executed.

Figure 2:
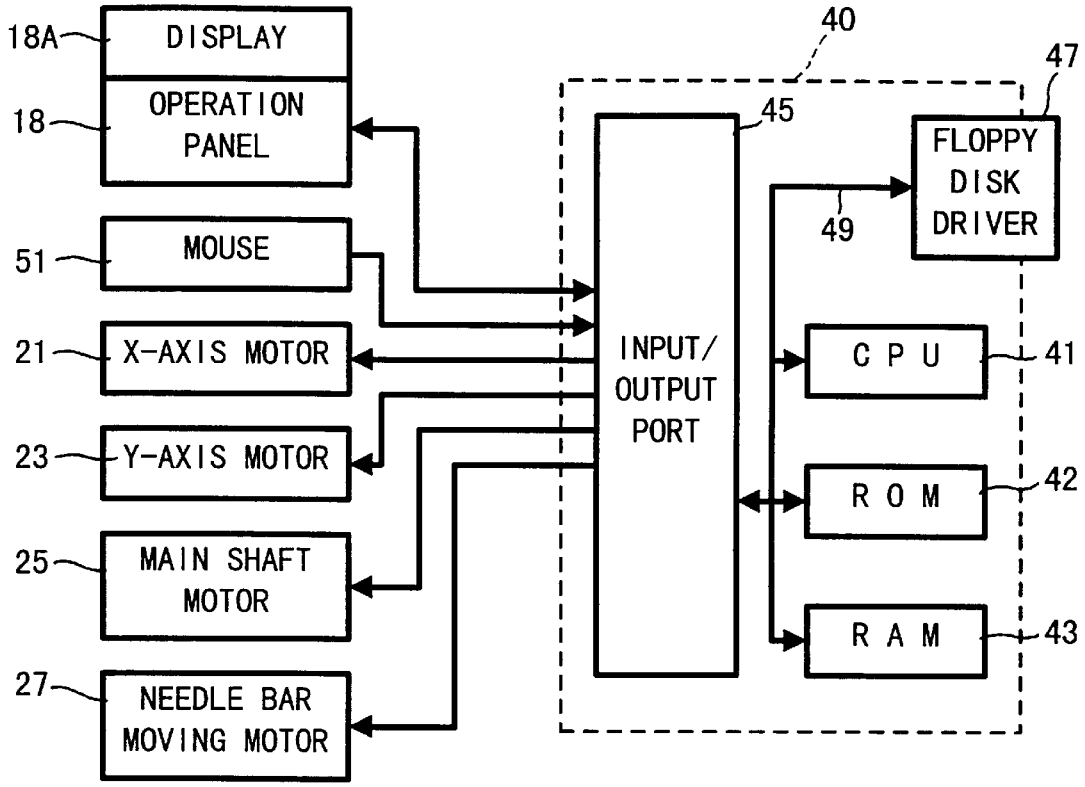
FIG. 2 is a block diagram showing a control system of the embroidery machine.

Built into the base frame 1 are, as shown in FIG. 2, an X-axis motor 21 and a Y-axis motor 23 which move the workpiece holding frame 16 in the X- and Y-axis directions, respectively, a main shaft motor 25 which drives a common main shaft (not shown) provided through the heads 4 to 6, and a needle bar moving motor 27 which simultaneously moves the cases 12 of the heads 4 to 6 laterally to change the respective needles 11 to which a driving force is transmitted from the main shaft. The motors 21, 23, 25, 27 are connected, together with the operation panel 18, to an electronic control circuit 40 which is also built into the base frame 1.

The electronic control circuit 40 is mainly formed of a central processing unit (CPU) 41, a read only memory (ROM) 42, and a random access memory (RAM) 43, and further comprises an input/output port 45 through which data is transmitted/received to/from the motors 21, 23, 25, 27 and the operation panel 18, and a floppy disk driver 47 which reads/writes data from/to a floppy disk (not shown) serving as a memory medium. The CPU 41, ROM 42, RAM 43, input/output port 45, and floppy disk driver 47 are connected via a bus 49 so that data can be transmitted/received therebetween. At a data transmission/reception portion of the input/output port 45, a known drive circuit (not shown) is provided for transmitting/receiving data to/from the motors 21, 23, 25, and 27. It is possible to connect a mouse 51 to the input/output port 45 via a connector (not shown). Another arrangement is also conceivable where a stylus pen, instead of the mouse, can be connected to the input/output port 45.

Described below is a routine executed by the electronic control circuit 40. When a floppy disk storing sewing data 71 (FIG. 4) is inserted into the floppy disk driver 47 and the power is turned on, and after predetermined operations are performed on the operation panel 18, the electronic control circuit 40 executes a main routine shown in the flowchart in FIG. 3 based on a program stored in the ROM 42.

Figure 3:
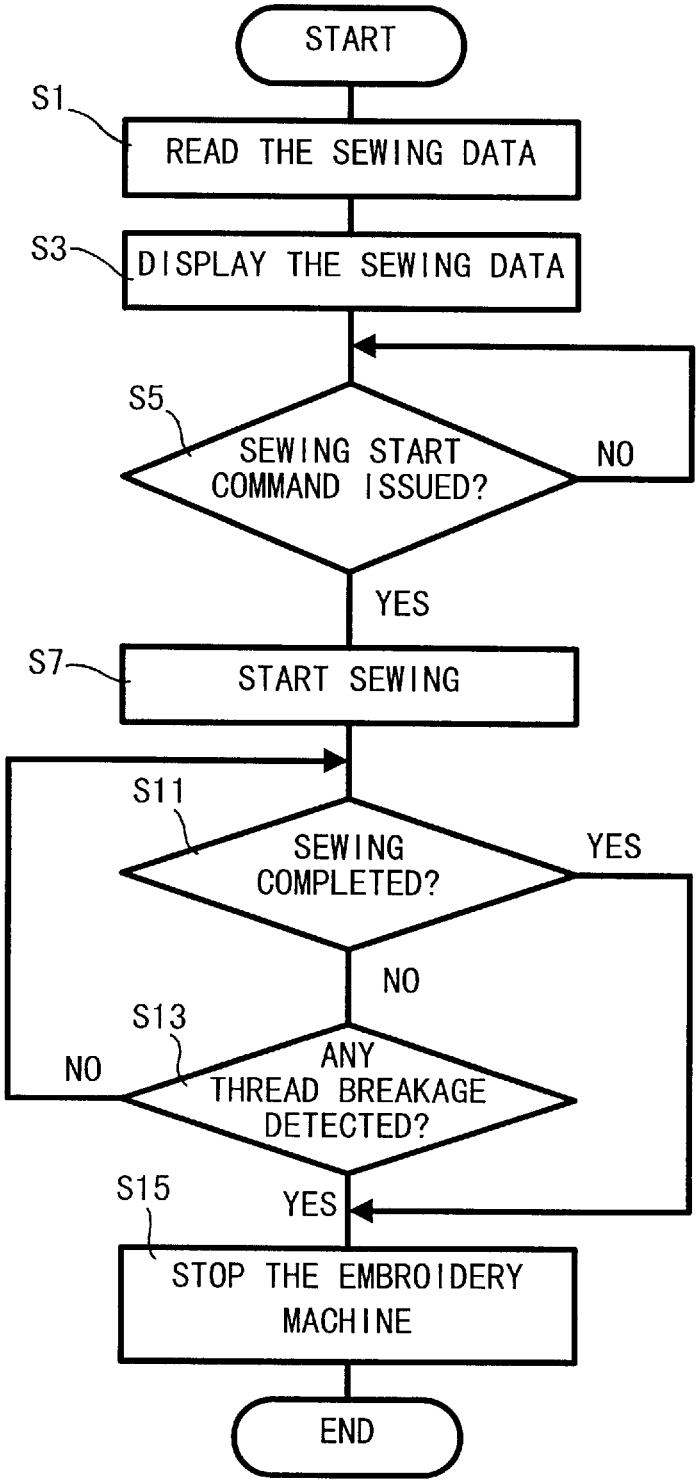
FIG. 3 is a flowchart showing a main routine executed by the control system.

As shown in FIG. 3, at the start of the main routine, the electronic control circuit 40 reads the sewing data 71 via the floppy disk driver 47 in S1 (hereinafter, S stands for a step). In S3, an embroidery pattern is displayed on the display 18A and a sewing start command is awaited (S5). When the sewing start command is issued (S5: YES), S7 is reached, where sewing is started by driving the motors 21, 23, 25, 27 according to the sewing data 71.

Figure 4:
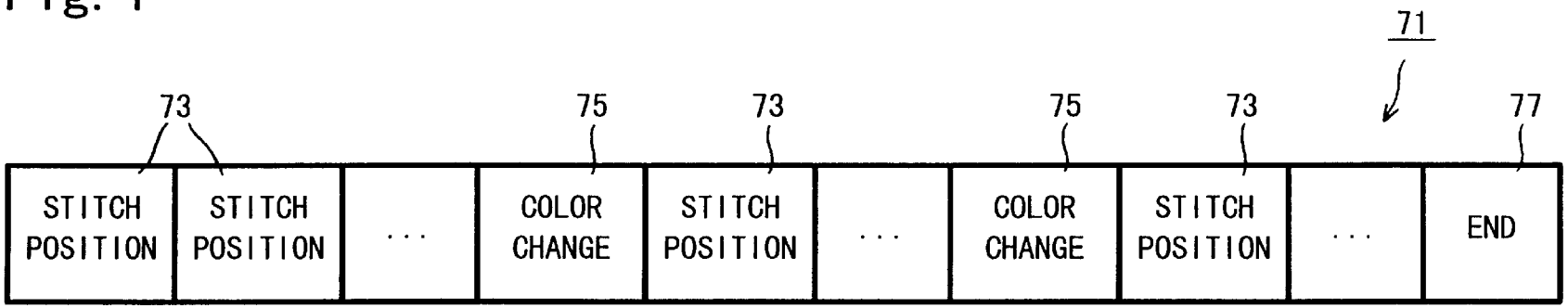
FIG. 4 is an illustrative diagram showing sewing data used in the control system.

As shown in FIG. 4, the sewing data 71 is a data string consisting of many pieces of stitch position data 73 which contains coordinates of a stitch position on the material being sewn and scattered pieces of color change data 75 which directs the change of the needle 11. A feed command (not shown), which will be described later, is added as needed to the stitch position data 73, and a piece of end data 77 which denotes the end of the data string is added to the end of the sewing data.

Sewing is executed as described below by a main sewing control routine (not shown in detail). Specifically, when the stitch position data 73 is read, the X-axis motor 21 and the Y-axis motor 23 are driven to adjust the stitch position on the material being sewn to the coordinates specified by the stitch position data 73. At the same time, the main shaft motor 25 is driven to vertically move the needle 11 in each head 4 to 6 to form a stitch on the material being sewn. When a feed command is added to the stitch position data 73, the needle 11 does not fall and moves to the next stitch position. When the color change data 75 is read, the needle bar moving motor 27 is driven to move the case 12. Then, the vertically moving needle 11 is changed in a predetermined order.

The subject matter of the invention is shown in FIG. 3. Steps S1–S11 are an overview of the main sewing control routine. In FIG. 3, S11, the above-mentioned sewing is judged as completed by detecting the end data 77. When it is not completed (NO), S13 is reached. In S13, a thread breakage at any of the heads 4 to 6 is determined by means of a thread breakage sensor (not shown as such are known in the art). When no thread breakage is detected (NO), control returns to S11. While the above steps are executed, the above-mentioned sewing continues and the progress of sewing is displayed on the display 18A.

When sewing is completed (S11: YES) or when a thread breakage is detected (S13: YES), a stop command is output to the motors 21, 23, 25, 27 in S15 to stop the embroidery machine, and the routine comes to an end. Also, when a stop command is issued, for example, from the operation panel 18 during sewing, sewing is judged completed (YES) in S11, and the embroidery machine is stopped (S15).

When the embroidery machine is stopped as described above, a routine for moving the sewing position can be executed subsequently. Referring now to the flowchart of FIG. 5, described below is the routine for moving the sewing position. The electronic control circuit 40 executes this routine based on a program stored in the ROM 42 when a predetermined input is made from the control panel 18 while the embroidery machine is stopped.

Figure 6:
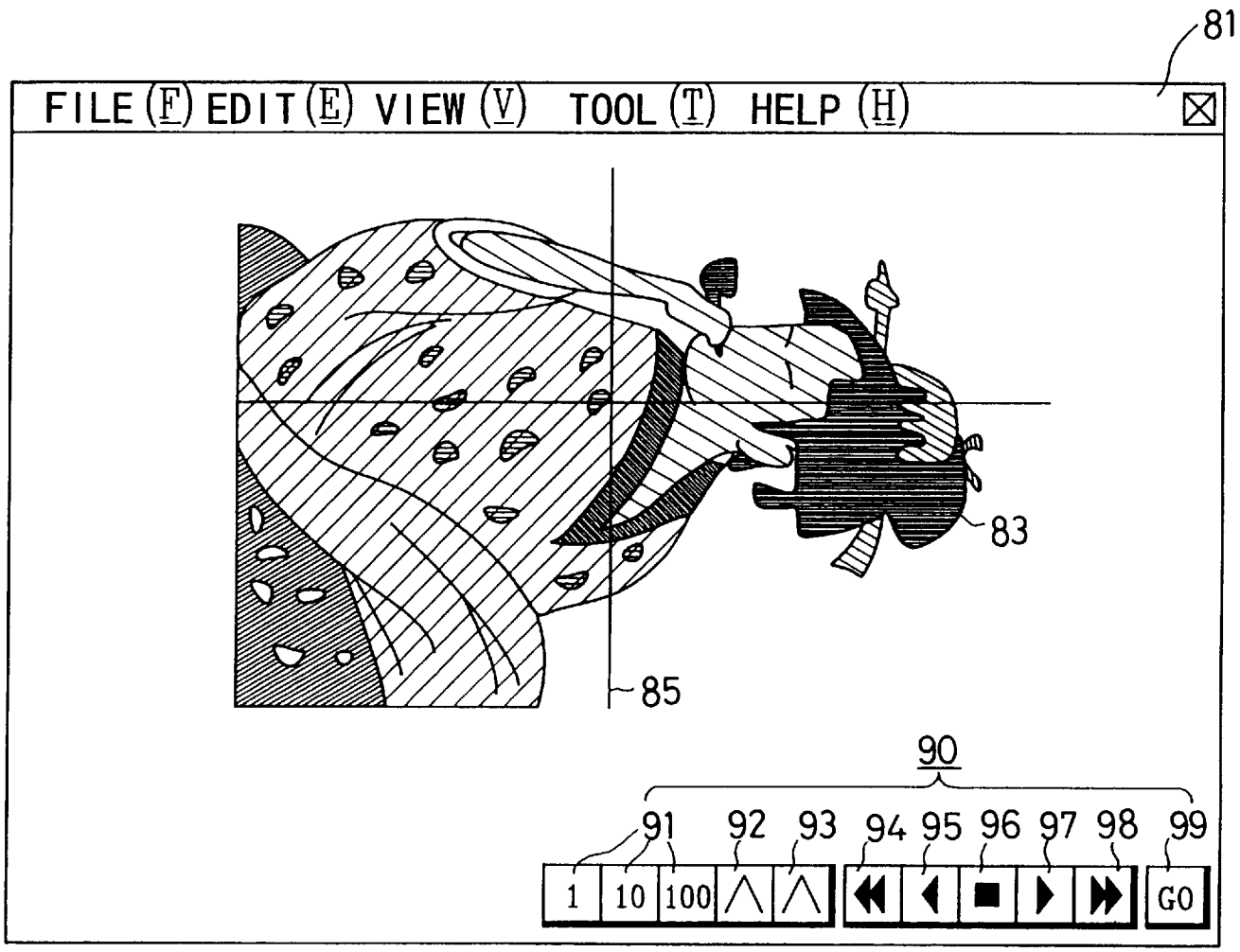
FIG. 6 is an example of the machine display.

When the routine is started, the current sewing position is displayed on the display 18A in S21. FIG. 6 shows an example of display given at this time. On the display 18A, a frame 81 is displayed and an embroidery pattern 83 is displayed inside the frame corresponding to the sewing data 71. The current sewing position (i.e. the stitch position of each head 4 to 6) is indicated by a cross-shaped cursor 85. As each head sews the same pattern simultaneously, the cursor 85 represents the sewing position for each head. In addition, switch portion 90 is displayed at the bottom inside the frame 81. The switch portion 90 comprises three number-of-stitches setting switches 91 used to set the feed generated by switches 94 to 98, a color change position switch 92, a feed position switch 93, a continuous return switch 94, a return switch 95, a stop switch 96, a feed switch 97, and a continuous feed switch 98 which are used to move the cross-shaped cursor according to the setting made using the switches 91 to 93, and a move switch 99 used to input a sewing position moving command which will be described later.

Figure 5:
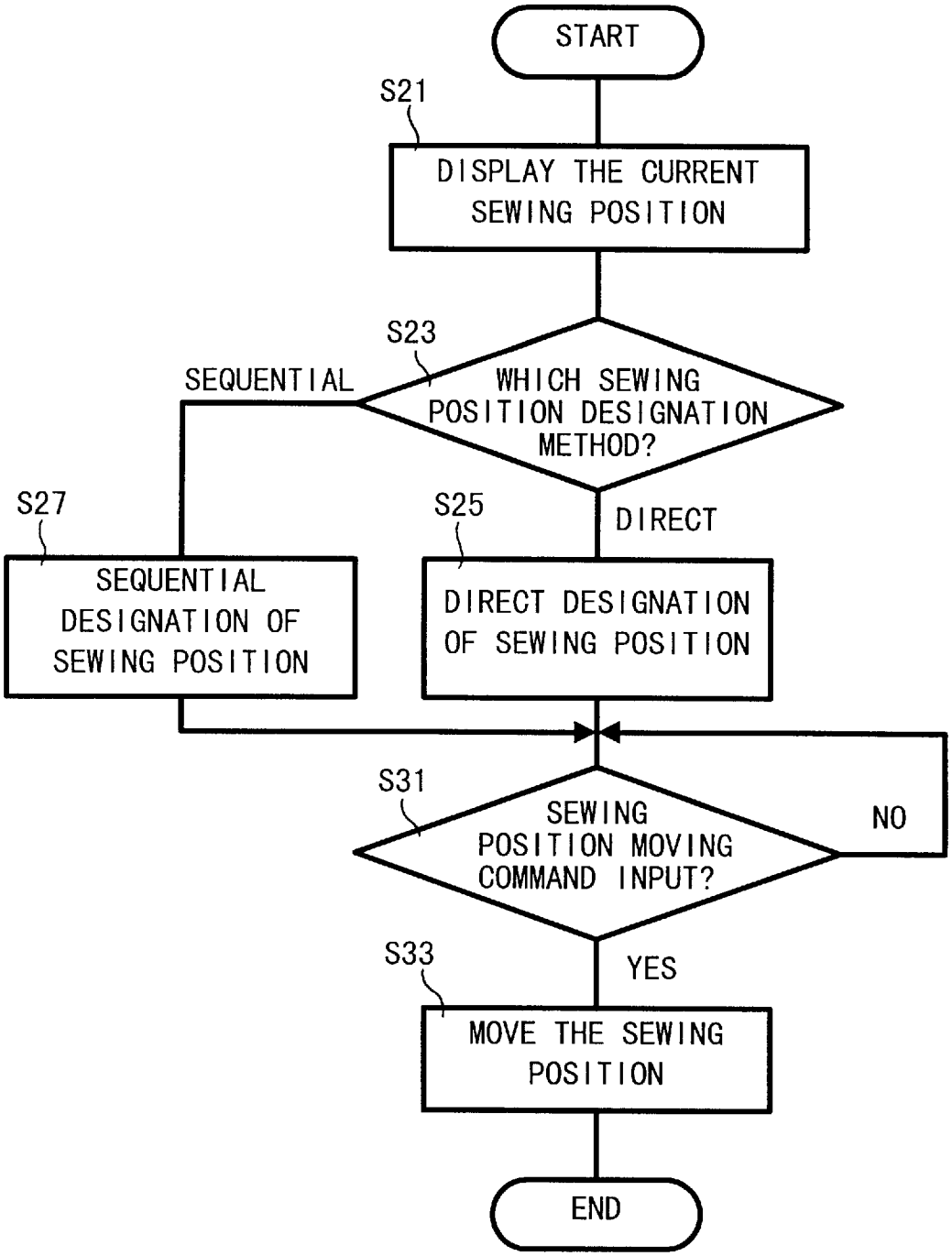
FIG. 5 is a flowchart for moving the sewing position.

Getting back to FIG. 5, in S23, whether the sewing position is designated directly or sequentially is judged. Direct designation means a method for directly designating, on the display 18A, the point to which the cross-shaped cursor 85 is moved. When the mouse 51 (not shown) is clicked while pointing at a position other than the switch portion 90 on the screen, that is judged to be direct designation in S23, and S25 is reached. Upon a shift to S25, the cross-shaped cursor 85 is moved and fixed at the position to which moved by the mouse 51 and subsequently clicked.

When any one of the switches 91 to 93 is clicked on, that is judged to be sequential designation in S23, and S27 is reached, where the position to which the cross-shaped cursor 85 is moved is designated as follows. When the feed switch 97 is clicked on, the cross-shaped cursor 85 is moved to a stitch position ahead by the number of stitches designated with the switch 91, 92, or 93 selected in the previous step. For example, when the number-of-stitches setting switch 91 is selected, the cursor is moved to a stitch position ahead by the number of stitches shown on that switch. When the color change position switch 92 is selected, the cursor is moved to a stitch position where the next color change data 75 is set. When the feed position switch 93 is selected, the cursor is moved to a stitch position where the next feed command is issued.

Likewise, when the continuous feed switch 98 is clicked on, the cross-shaped cursor 85 is moved continuously in units of the above-mentioned number of stitches or continuously from one stitch position to another. When the return switch 95 is selected, the cross-shaped cursor 85 is returned by the above-mentioned number of stitches or to the corresponding stitch position. When the continuous return switch 94 is selected, the cross-shaped cursor 85 is returned continuously in units of the above-mentioned number of stitches or continuously from one stitch position to another. When the stop switch 96 is clicked on, the cross-shaped cursor 85 is fixed at its current position.

When the cross-shaped cursor 85 is fixed at the desired position (S25, S27) as described above, S31 is reached, where input of a sewing position moving command via the move switch 99 is awaited. When the sewing position moving command is input (S31: YES), the X-axis motor 21 and the Y-axis motor 23 are driven in S33 to move the stitch position of each head 4 to 6 to the position indicated by the cross-shaped cursor 85, and the routine comes to an end. This movement is accomplished while the main shaft motor 25 and the needle bar moving motor 27 are stopped, that is, while the needle 11 and the case 12 in each head 4 to 6 are stopped. This movement may be accomplished either in the shortest possible distance by simultaneously driving the X-axis motor 21 and the Y-axis motor 23 or by sequentially driving the motors 21, 23. In the above routine, the stitch position of each head 4 to 6 is adjusted to the desired position, from which sewing can be started by the head suffering the broken thread. The remaining heads will recommence sewing when the sewing has proceeded to the point where the breakage occurred as is known in the art.

As described above, in the embroidery machine according to the invention, the position to which the stitch position is moved is indicated by the cross-shaped cursor 85 operated using the mouse 51 or the switch portion 90, and, according to that position, the workpiece holding frame 16 can be moved. Therefore, the material being sewn can be moved quickly to the desired position. Furthermore, the position to which the stitch position is moved can be designated quite easily by confirming it on the screen of the display 18A. Therefore, in the embroidery machine according to the invention, moving the material being sewn relative to each head 4 to 6 and moving the stitch position to the desired position can be executed easily and quickly.

The stitch position is moved, in most cases, along the stitch positions specified by the sewing data 71. In this case, however, the cross-shaped cursor 85 can be moved along the stitch positions by operating the switch portion 90. In addition, by doing so, the cross-shaped cursor 85 can be moved to a stitch position specified for feed or for color change, or can be moved in units of 10 stitches or 100 stitches. Therefore, in the embroidery machine according to the invention, the cross-shaped cursor 85 can be moved to the desired position more easily and quickly. On the other hand, by direct designation of the sewing position, the point to which the stitch position is moved can be designated freely regardless of the sewing data 71. Furthermore, when a thread breakage is detected in the embroidery machine (S13: YES), the machine is stopped immediately (S15) to enable execution of the sewing position moving routine in FIG. 5. As a result, sewing can be restarted quite quickly after a thread breakage occurs.

In the above preferred embodiment, the workpiece holding frame 16, X-axis motor 21, and Y-axis motor 23 correspond to a material mover; sewing started in S7 and a memory area of the ROM 42 where a program of S7 is stored correspond to a sewing controller; the display 18A, step S21, and a memory area in the ROM 42 where a program of S21 is stored correspond to a display unit; the mouse 51, step S25, and a memory area in the ROM 42 where a program of S25 is stored correspond to an indicator; the mouse 51, switch portion 90, step S27 and a memory area of the ROM 42 where a program of S27 is stored correspond to a point mover; step S33 and a memory area of the ROM 42 where a program of S33 is stored correspond to a movement controller; the thread breakage sensor, step S13, and a memory area of the ROM 42 where a program of S13 is stored correspond to a thread breakage detector; and step S15, a known flag process which permits the process in FIG. 5 upon stoppage of the embroidery machine and a memory area of the ROM 42 where a program of these processes are stored correspond to a control selector.

The invention is not restricted to the particular forms in the foregoing embodiment and various modifications and alternations can be made thereto without departing from the scope of the invention. For example, this invention may be applied to various sewing machines including a so-called pocket setter in which the periphery of a pocket is sewn on the material. Although, in the above preferred embodiment, the routines described in FIGS. 3 through 6 are executed using the electronic control circuit 40 built into the base frame 1, they may be executed using, for example, a personal computer provided separately from the embroidery machine, and the embroidery machine may be controlled from the personal computer by sending drive signals thereto via a communication cable or a radio wave transmission/reception portion. In addition, when the embroidery machine is stopped upon detection of a thread breakage, a position where the thread breakage occurred may be displayed on the screen shown in FIG. 6. In this case, automatic movement of the stitch position to the position where a thread breakage occurred may also be accomplished.

Although, in the above preferred embodiment, coordinate position data is used as the sewing data, the invention may be applied to sewing machines which perform sewing using, for example, block data and outline data. In this case, direct designation (S25) of the sewing position using, for example, the mouse 51 can be performed in the same manner as in the above preferred embodiment. When only direct sewing position designation is performed, the crossshaped cursor 85 dose not necessarily need to be displayed.

As described above, in the embroidery machine according to the preferred embodiment, the stitch position can be moved easily and quickly to the desired position by moving the material relative to the head.

What is claimed is:

1. A sewing machine, comprising:

a head which drives a needle to form a stitch on a material;

a material mover which moves the material relative to the head;

a sewing controller which controls the head and the material mover based on sewing data and performs sewing on the material according to the sewing data;

a display unit which displays the sewing data as an image;

an indicator which indicates an arbitrary point on the image displayed by the display unit; and a movement controller which relatively moves the material by controlling the material mover without causing the needle to vertically move so that a stitch position defined by the head is moved to the point indicated by the indicator.

2. A sewing machine, comprising:

a head which drives a needle to form a stitch on a material;

a material mover which moves the material relative to the head;

a controller which controls the head and the material mover based on coordinate position data specifying stitch positions of the needle so that sewing is performed on the material according to the coordinate position data;

a display unit which displays the coordinate position data as an image;

a point mover which moves a point along the stitch positions on the image displayed by the display unit; and a movement controller which relatively moves the material by controlling the material mover without causing the needle to vertically move so that a stitch position defined by the head is directly moved to the point moved by the point mover regardless of other stitch positions.

3. The sewing machine as claimed in claim 2, wherein the sewing controller is so arranged as to execute relative feed of the material or color change of a thread to be formed into a stitch by controlling the material mover while the needle is kept raised during sewing, and the point mover moves the point to a stitch position where the feed or color change is executed.

4. The sewing machine as claimed in claim 1, further comprising a thread breakage detector which detects a breakage of a thread to be formed into a stitch and a control selector which, upon detection of a thread breakage, stops the sewing controller from controlling the head and the material mover and permits the movement controller to control the material mover while the sewing controller is stopped.

5. The sewing machine as claimed in claim 2, further comprising a thread breakage detector which detects a breakage of a thread to be formed into a stitch and a control selector which, upon detection of a thread breakage, stops the sewing controller from controlling the head and the material mover and permits the movement controller to control the material mover while the sewing controller is stopped.

6. The sewing machine as claimed in claim 1, wherein the indicator is formed of a mouse and a cross-shaped cursor displayed on the display unit.

7. The sewing machine as claimed in claim 2, wherein the point mover has a feed switch and a return switch.

8. The sewing machine as claimed in claim 7, wherein the point mover has a number-of-stitches setting switch.

9. The sewing machine as claimed in claim 7, wherein the point mover has a continuous feed switch and a continuous return switch.

10. The sewing machine as claimed in claim 1, wherein a plurality of heads are provided.

11. The sewing machine as claimed in claim 1, comprising:

a display unit which displays coordinate position data as an image;

a point mover which moves a point along stitch positions on the image displayed by the display unit; and a movement controller which relatively moves the material by controlling the material mover without causing the needle to vertically move so that the stitch position defined by the head is directly moved to the point moved by the point mover regardless of other stitch positions.

12. A method of repositioning a piece of material relative to a sewing needle of a sewing machine, comprising the steps of:

reading sewing data;

displaying the sewing data on a display;

initiating sewing;

determining a sewing stoppage;

displaying on the display a current sewing position;

designating a next sewing position on the display; and moving the piece of material to a position corresponding to the next sewing position under the sewing needle.

13. The method as claimed in claim 12, wherein the determination of a stoppage comprises the steps of:

determining whether sewing is complete;

determining if a thread breakage has occurred; and stopping feed of the piece of material and movement of the sewing needle when one of sewing is complete and the thread breakage is determined, wherein the sewing needle is stopped at a position separated from the piece of material.

14. The method as claimed in claim 12, wherein the step of designating a next sewing position comprises one of moving a cursor on the display to the next sewing position and designating a direction and extent of movement based upon the sewing data.

15. The method as claimed in claim 14, wherein the step of designating a direction and extent of movement comprises the steps of:

selecting one of a number of stitches to move and a function of movement; and designating one of step wise movement and continuous movement.

16. The method as claimed in claim 15, wherein the selecting the number of stitches to move comprises one of one stitch, ten stitches and 100 stitches for each move.

17. The method as claimed in claim 15, wherein selecting a function of movement comprises selecting between one of moving to a next feed command and a next change color command in the sewing data for each move.

18. The method as claimed in claim 17, further comprising the step of recommencing sewing after moving the piece of material.

19. A sewing machine, comprising:

head means for driving a needle to form a stitch on a material;

material moving means for moving the material relative to the head means;

sewing control means for controlling the head and the material moving means based on sewing data and for performing sewing on the material according to the sewing data;

display means for displaying the sewing data as an image;

indicator means for indicating an arbitrary point on the image displayed by the display means; and movement control means for relatively moving the material by controlling the material moving means without causing the needle to vertically move so that a stitch position defined by the head is moved to the point indicated by the indicator means.

20. A sewing machine, comprising:

head means for driving a needle to form a stitch on a material;

material moving means for moving the material relative to the head means;

control means for controlling the head means and the material moving means based on coordinate position data specifying stitch positions of the needle so that sewing is performed on the material according to the coordinate position data;

display means for displaying the coordinate position data as an image;

point moving means for moving a point along the stitch position on the image displayed by the display means; and movement control means for relatively moving the material by controlling the material moving means without causing the needle to vertically move so that a stitch position defined by the head means is directly moved to the point moved by the point moving means regardless of other stitch positions.

* * * * *